US006325599B1

(12) United States Patent
Herder et al.

(10) Patent No.: US 6,325,599 B1
(45) Date of Patent: Dec. 4, 2001

(54) PISTON HAVING ANTI-ROTATION FOR SWASHPLATE COMPRESSOR

(75) Inventors: David Herder, Plymouth; Lavlesh Sud; Shane A. Harte, both of Farmington Hills; Yong Huang, Ann Arbor, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/542,619

(22) Filed: Apr. 4, 2000

(51) Int. Cl.[7] ..... F04B 1/12; F01B 3/00; F16J 16/18

(52) U.S. Cl. ..... 417/269; 92/71; 92/165 PR

(58) Field of Search ..... 417/269; 91/499; 92/71, 172, 165 PR

(56) References Cited

U.S. PATENT DOCUMENTS

| | | | | |
|---|---|---|---|---|
| 2,622,567 | | 12/1952 | Myard | 121/101 |
| 3,938,397 | | 2/1976 | Rasmussen | 74/60 |
| 3,939,717 | | 2/1976 | Teisen | 74/60 |
| 4,379,425 | * | 4/1983 | Ishizuka | 92/71 |
| 4,963,074 | | 10/1990 | Sanuki et al. | 417/222 |
| 5,228,841 | * | 7/1993 | Kimura et al. | 417/222.2 |
| 5,382,139 | | 1/1995 | Kawaguchi et al. | 417/269 |
| 5,461,967 | | 10/1995 | Burkett et al. | 92/71 |
| 5,490,767 | * | 2/1996 | Kanou et al. | 417/222.1 |
| 5,615,599 | * | 4/1997 | Terauchi | 92/165 R |
| 5,706,716 | | 1/1998 | Umemura | 92/165 PR |
| 5,720,215 | * | 2/1998 | Asplund et al. | 92/71 |
| 5,738,000 | | 4/1998 | Forster | 92/165 R |
| 5,771,775 | | 6/1998 | Ota et al. | 92/165 PR |
| 5,868,556 | | 2/1999 | Umemura | 417/269 |
| 5,934,172 | * | 8/1999 | Terauchi | 92/465 PR |

FOREIGN PATENT DOCUMENTS 258916 of 1928 (IT) .

* cited by examiner

*Primary Examiner*—Charles G. Freay
*Assistant Examiner*—Timothy P. Solak
(74) *Attorney, Agent, or Firm*—Larry I. Shelton

(57) ABSTRACT

A piston having anti-rotation for a swashplate compressor includes a body portion extending axially and a connecting portion spaced radially from a longitudinal axis of the body portion and extending axially. The piston also includes a pair of opposed anti-rotation wings extending radially from one end of the body portion between the connecting portion and the longitudinal axis of the body portion.

27 Claims, 4 Drawing Sheets

PISTON HAVING ANTI-ROTATION FOR SWASHPLATE COMPRESSOR

BACKGROUND OF THE INVENTION

1. Field of the Invention

The present invention relates generally to air conditioning systems for vehicles and, more specifically, to a piston having anti-rotation for a swashplate compressor of an air conditioning system in a motor vehicle.

2. Description of the Related Art

It is known to provide an air conditioning system for a motor vehicle. The air conditioning system typically carries a fluid medium such as a refrigerant to cool air for an occupant compartment of the motor vehicle. It is also known to provide a compressor for the air conditioning system to compress the refrigerant circulating therethrough. One type of compressor for an air conditioning system is known as a swashplate compressor. An example of such a compressor for an air conditioning system is disclosed in U.S. Pat. No. 5,720,215. In this patent, the compressor has a housing with a cylindrical inner surface surrounding a cylinder block having a series of cylinder bores. A central drive shaft rotates a slanted swashplate that moves axially in a reciprocating manner to drive corresponding pistons connected thereto in their cylinder bores. Unlike wobble plate driven pistons, there is a need to limit the rotation of the pistons in a swashplate compressor. The swashplate compressor has anti-rotation wings that prevent the piston from rubbing with the swashplate. However, the limiting housing dimension is dependent on the swashplate mechanism in the crankcase.

It is desirable to provide a piston for a swashplate compressor of an air conditioning system with an anti-rotation feature. It is also desirable to provide a piston for a swashplate compressor of an air conditioning system that allows for much tighter packaging of the compressor. It is further desirable to provide anti-rotation wings for the pistons in a swashplate compressor to limit rotation of the pistons. Therefore, there is a need in the art to provide a piston having anti-rotation for a swashplate compressor of an air conditioning system that accomplishes these desires.

SUMMARY OF THE INVENTION

Accordingly, the present invention is a piston having anti-rotation for a swashplate compressor including a body portion extending axially and a connecting portion spaced radially from a longitudinal axis of the body portion and extending axially. The piston also includes a pair of opposed anti-rotation wings extending radially from one end of the body portion between the connecting portion and the longitudinal axis of the body portion.

One advantage of the present invention is that a piston having anti-rotation is provided for a swashplate compressor of an air conditioning system of a vehicle. Another advantage of the present invention is that the piston has anti-rotation wings moved closer to a centerline of the piston, enabling the anti-rotation feature of the swashplate compressor to be maintained within a tighter packaging space.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
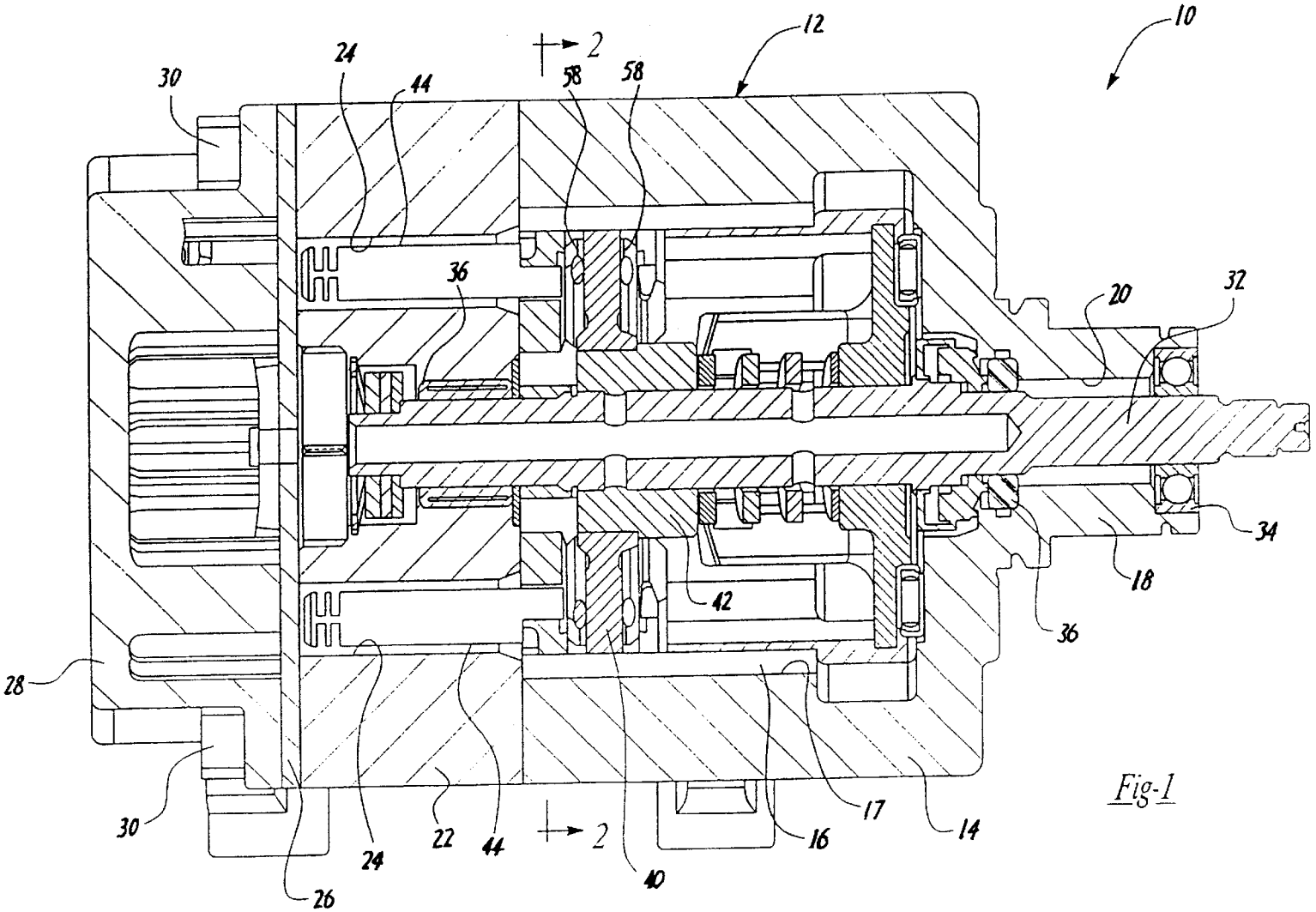
FIG. 1 is a fragmentary elevational view of a piston having anti-rotation, according to the present invention, illustrated in operational relationship with a swashplate compressor for use with an air conditioning system.
Figure 2:
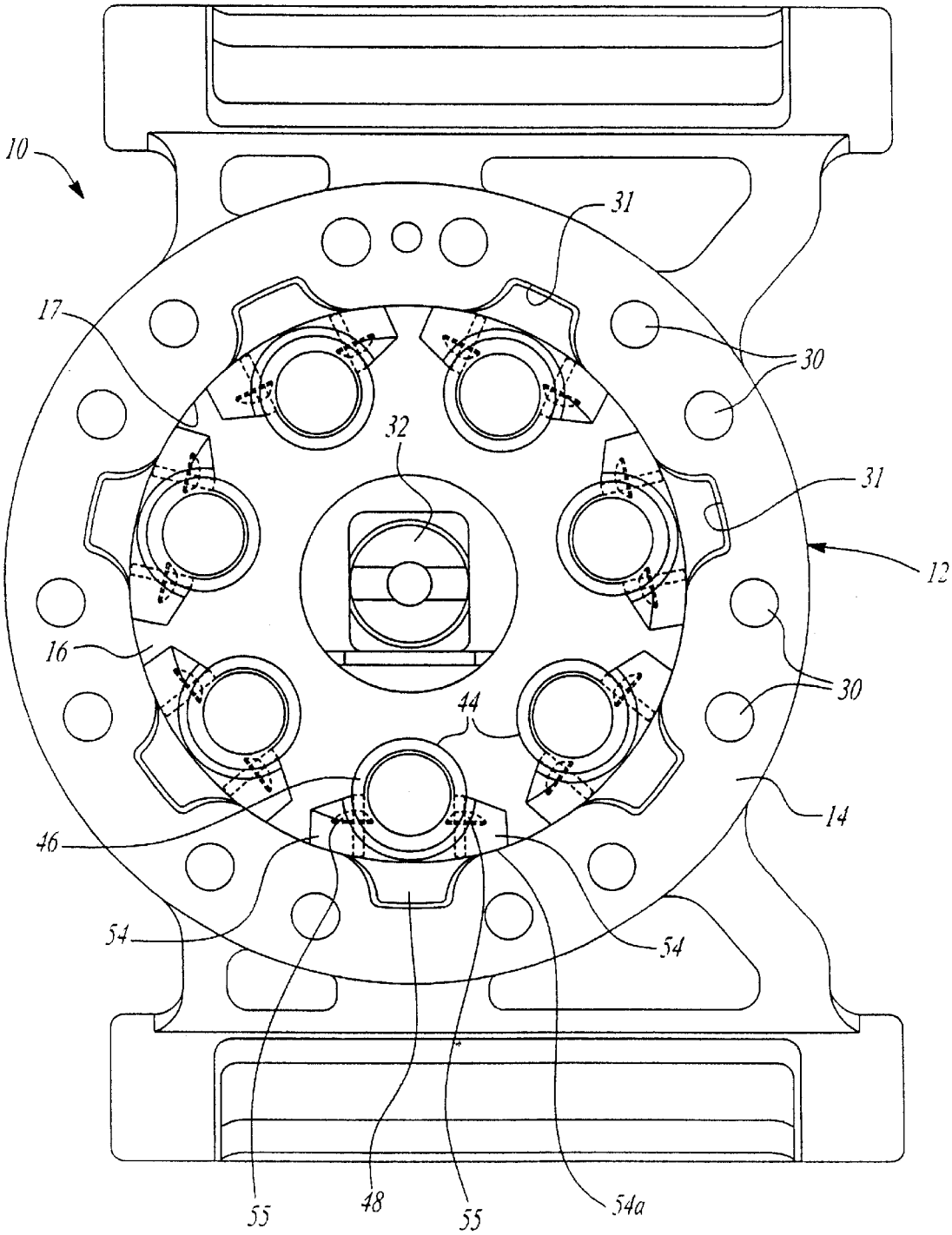
FIG. 2 is a sectional view taken along line 2—2 of FIG. 1.

Referring to the drawings and in particular FIGS. 1 and 2, one embodiment of a swashplate compressor 10, according to the present invention, is shown for a refrigerant system such as an air conditioning system (not shown) of a vehicle such as a motor vehicle (not shown). The swashplate compressor 10 relates to fixed or variable swashplate compressors. As illustrated in FIGS. 1 and 2, the swashplate compressor 10 is of the variable type. It should be appreciated that the swashplate compressor 10 could be of the fixed type.

The swashplate compressor 10 includes a housing, generally indicated at 12, having a first or shaft housing 14 with a cavity 16 formed by an inner surface 17. The first housing 14 is generally cylindrical in shape with a generally circular cross-section. The first housing 14 has a projection 18 extending axially at one end with a passage 20 extending axially therethrough and communicating with the cavity 16.

The housing 12 also includes a second or cylinder housing 22 disposed adjacent the first housing 14. The second housing 22 is generally cylindrical in shape with a generally circular cross-section. The second housing 22 has at least one, preferably a plurality of cylinder bores 24 extending axially therethrough and spaced circumferentially thereabout. The cylinder bores 24 extend axially and are generally circular in shape.

The housing 12 includes an end plate 26 disposed adjacent the second housing 22. The end plate 26 is generally circular in shape. The housing 12 also includes an end or third housing 28 disposed adjacent the end plate 26. The third housing 28 is generally cylindrical in shape with a generally circular cross-section. The housing 12 further includes at least one, preferably a plurality of fasteners 30 such as bolts to secure the third housing 28, end plate 26, second housing 22 and first housing 14 together. The housing 12 includes at least one, preferably a plurality of slots 31 extending axially in the second housing 22 and spaced circumferentially thereabout for a function to be described. The slots 31 are generally trapezoidal in shape and spaced circumferentially between a pair of adjacent fasteners 30. The housing 12 is made of a metal material such as steel. It should be appreciated that the swashplate compressor 10 could be used for air conditioning systems in other applications besides motor vehicles. It should further be appreciated that the swashplate compressor 10 may be used with refrigerant systems other than an air conditioning system.

Figure 3:
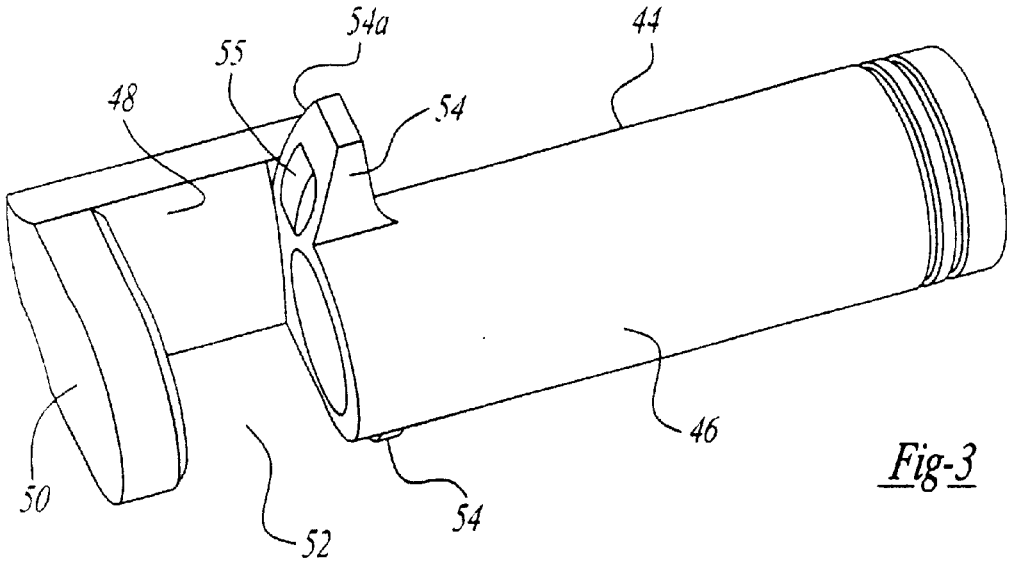
FIG. 3 is a perspective view of the piston having anti-rotation of FIGS. 1 and 2.

Referring to FIGS. 1 through 3, the swashplate compressor 10 includes a rotatable shaft 32 extending axially through the first housing 14 and second housing 22. The shaft 32 has a generally circular cross-sectional shape and is made of a rigid material such as steel. The swashplate compressor 10 includes a plurality of bearings 34 and bushings 36 to support the shaft 32 in the housing 12. It should be appreciated that the shaft 32 extends through the passageway 20 and out of the first housing 14 for connection to a device (not shown) to rotate the shaft 32.

The swashplate compressor 10 includes a swashplate 40 disposed in the cavity 16 of the first housing 14 and about the shaft 32 by a support member 42. The swashplate 40 is generally circular in shape and disposed about the support member 42. The support member 42 is generally cylindrical in shape and disposed about the shaft 32. The swashplate 40 and support member 42 are made of a metal material such as steel. It should be appreciated that the shaft 32, support member 42 and swashplate 40 rotate as a unit.

Referring to FIGS. 1 through 3, the swashplate compressor 10 includes at least one, preferably a plurality of pistons 44, according to the present invention, connected to and driven by the swashplate 40. The pistons 44 have a body portion 46 that is generally cylindrical in shape with a generally circular cross-section. The pistons 44 have a connecting portion 48 extending axially from one end of the body portion 46 at a periphery thereof. The connection portion 48 has a generally trapezoidal cross-sectional shape and is disposed in the slots 31 of the housing 12. The piston 44 also have a flange portion 50 extending radially from one end of the connecting portion 48 to form an axial space 52 between the end of the body portion 46 and the flange portion 50. The space 52 allows the piston 44 to fit over the edge of the swashplate 40. The pistons 44 further have a pair of opposed anti-rotation wings 54 extending radially from one end of the body portion 46 adjacent the connection portion 48. The anti-rotation wings 54 are spaced radially from a longitudinal axis of the body portion 46. The anti-rotation wings 54 have a contact surface 54*a* which is rounded or complementary to and abuts the inner surface 17 of the cavity 16 to prevent the pistons 44 from rotating due to the sliding and twisting of the pistons 44 when in a reciprocating manner. The anti-rotation wings 54 may include an aperture or groove 55 extending axially therethrough. The groove 55 is generally oval shaped. The groove 55 allows the swashplate 40 to turn in both directions to its fullest angle without interference to move to a full capacity position. The body portion 46, connecting portion 48, flange portion 50 and anti-rotation wings 54 are integral, unitary and one-piece. It should be appreciated that each piston 44 is a monolithic structure.

The swashplate compressor 10 includes a pair of half plate shoes 58 disposed in the space 52 of the piston 44 with one shoe 58 between the swashplate 40 and the flange portion 50 and another shoe 58 between the swashplate 40 and the body portion 46. The half plate shoes 58 allow the swashplate 40 edge to both slide freely and twist through the space 52 as the piston 40 is driven in a reciprocating manner. It should be appreciated that the sliding and twisting action can impose a twisting force on the piston 44, causing it to turn about its own axis within the bore 24.

In operation of the swashplate compressor 10, the shaft 32 is rotated by an external drive (not shown). The rotation of the shaft 32 causes the swashplate 40 to rotate. As the swashplate 40 rotates, the pistons 44 slide in the cylinder bores 24 to compress the refrigerant. The connecting portion 48 slides in the slot 31 and the anti-rotation wings 54 slide along the inner surface 17 and prevent the piston 44 from twisting and rotating. It should be appreciated that the swashplate 40 is slanted to vary the amount of compression for the pistons 44 to compress the refrigerant.

Figure 4:
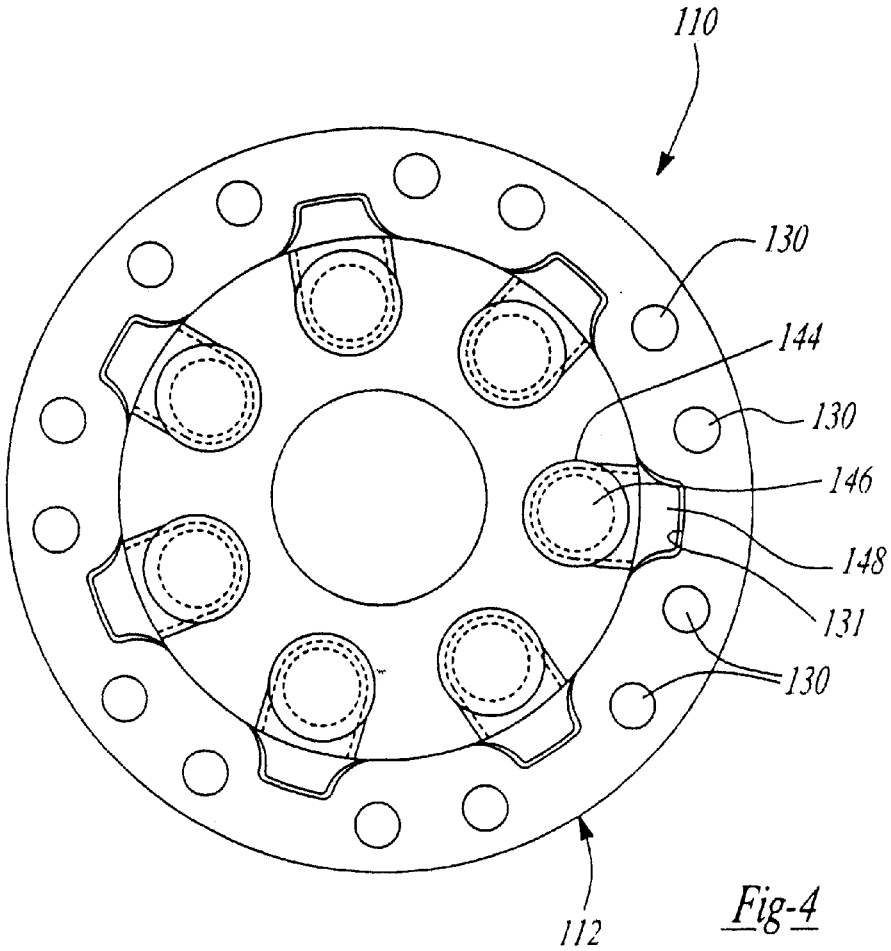
FIG. 4 is a side elevational view of another embodiment, according to the present invention, of the piston having anti-rotation and swashplate of FIG. 1.
Figure 5:
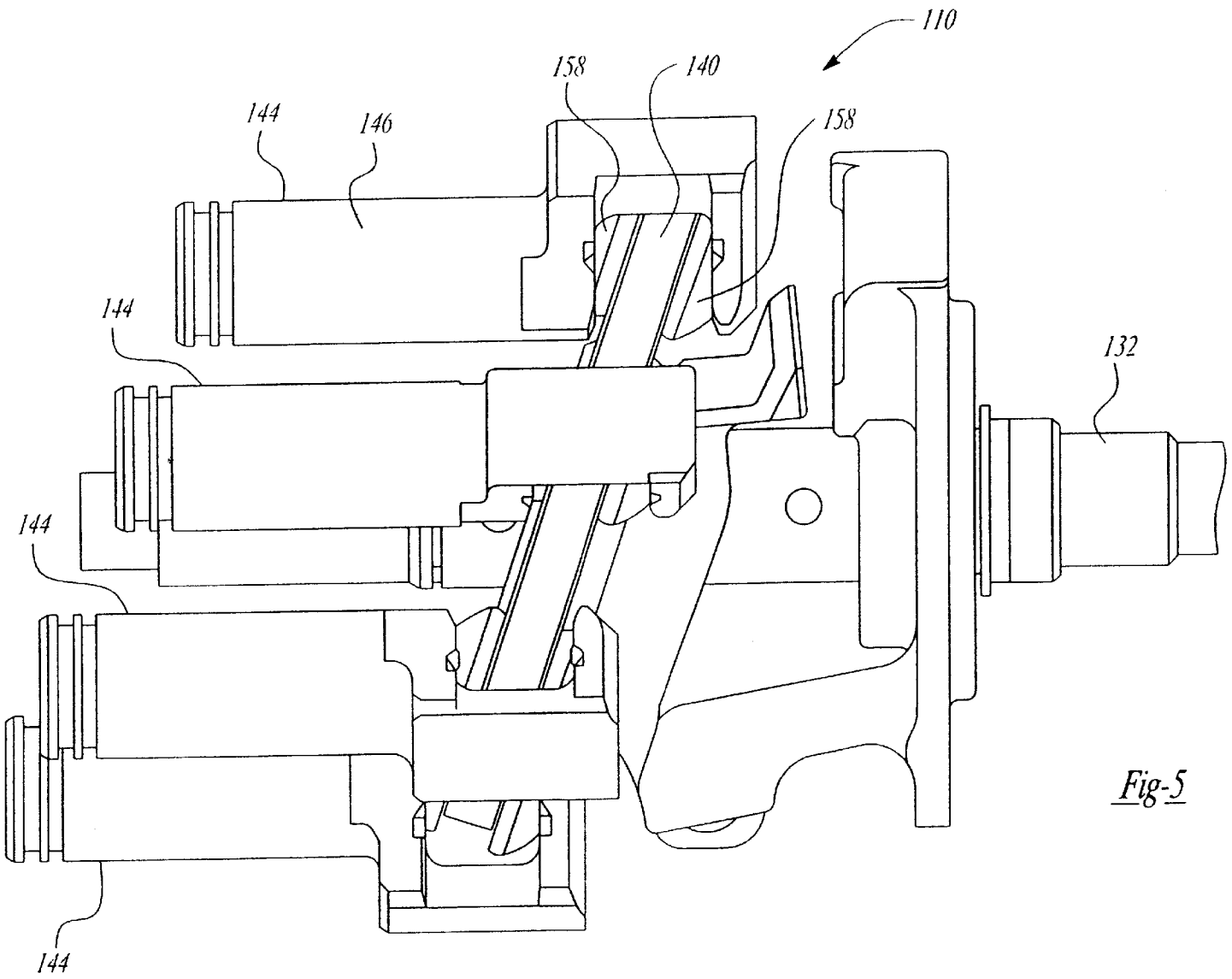
FIG. 5 is an elevational view of the swashplate compressor of FIG. 1 illustrating the housing removed.

Referring to FIGS. 4 and 5, another embodiment 110, according to the present invention, of the swashplate compressor 10 is shown. Like parts of the swashplate compressor 10 have like reference numerals increased by one hundred (100). In this embodiment, the swashplate compressor 110 eliminates the anti-rotation wings on the pistons 144. The slots 131 in cooperation with the connecting portion 148 of the pistons 144 act as an anti-rotation feature. The swashplate compressor 110 operates similar to the swashplate compressor 10.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A piston having anti-rotation for a swashplate compressor comprising:

a head portion slidably engageable in an axial direction within a piston bore;

a body portion extending axially from said head portion;

a flange portion cooperating with said body portion to form an axial space between said flange portion and said body portion;

a connecting portion spaced radially from a longitudinal axis of said body portion adapted to support said flange portion and extending axially; and a pair of opposed anti-rotation wings extending radially from said body portion.

2. A piston having anti-rotation as set forth in claim 1 wherein said anti-rotation wings have an aperture extending axially therethrough.

3. A piston having anti-rotation as set forth in claim 1 including a flange portion extending radially from one end of said connecting portion to form an axial space between said flange portion and said body portion.

4. A piston having anti-rotation as set forth in claim 3 wherein said body portion, said connecting portion, said flange portion and said anti-rotation wings are integral with each other, unitary and one piece.

5. A piston having anti-rotation as set forth in claim 1 wherein said body portion is generally cylindrical in shape.

6. A piston having anti-rotation as set forth in claim 1 wherein said connecting portion has a generally trapezoidal shape.

7. A piston having anti-rotation as set forth in claim 1 wherein said body portion is centered along the longitudinal axis of said head portion.

8. A piston having anti-rotation as set forth in claim 1 wherein said connecting portion is spaced radially from said body portion.

9. A piston having anti-rotation as set forth in claim 1 wherein said anti-rotation wings have a contacting portion in contact with a housing inner surface.

10. A piston having anti-rotation as set forth in claim 9 wherein said contacting portion has generally the same radius of curvature as the cylinder wall.

11. A piston having anti-rotation as set forth in claim 1 wherein said connecting portion is spaced radially from a longitudinal axis of said piston body portion and extending axially, wherein said longitudinal axis is generally along the peripheral of said piston body portion and the piston head portion.

12. A piston having anti-rotation as set forth in claim 1 wherein said axial space is adapted to support a pair of shoes coupling a swashplate.

13. A swashplate compressor comprising:

a housing having an inner surface forming a cavity and at least one slot extending axially along said inner surface, said housing including at least one cylinder bore;

a shaft extending through said housing and into said cavity and rotatable relative to said housing;

a swashplate operatively connected to said shaft for rotation therewith; and at least one piston disposed in said at least one cylinder bore and operatively connected to said swashplate for reciprocating movement as said swashplate rotates, said at least one piston having a head portion slidably engageable in an axial direction within a piston bore, a body portion extending axially from said head portion, a flange portion cooperating with said body portion to form an axial space between said flange portion and said body portion, a protruding portion spaced radially from a longitudinal axis of said body portion adapted to support said flange portion wherein said protruding portion is extending axially and disposed in said at least one slot, and a pair of opposed anti-rotation wings extending radially from said body portion.

14. A swashplate compressor as set forth in claim 13 wherein each of said anti-rotation wings have an aperture extending axially therethrough.

15. A swashplate compressor as set forth in claim 13 including a flange portion extending radially from one end of said protruding portion to form an axial space between said flange portion and said body portion.

16. A swashplate compressor as set forth in claim 15 wherein said body portion, said protruding portion, said flange portion and said anti-rotation wings are integral with each other, unitary and one piece.

17. A swashplate compressor as set forth in claim 13 wherein said body portion is generally cylindrical in shape.

18. A swashplate compressor as set forth in claim 13 wherein said protruding portion has a generally trapezoidal shape.

19. A swashplate compressor as set forth in claim 13 wherein said body portion of said at least one piston is centered along the longitudinal axis of said head portion.

20. A swashplate compressor as set forth in claim 13 wherein said protruding portion of said at least one piston is spaced radially from said body portion.

21. A swashplate compressor as set forth in claim 13 wherein said anti-rotation wings have a contacting portion in contact with said inner surface.

22. A swashplate compressor as set forth in claim 21 wherein said contacting portion has generally the same radius of curvature as the cylinder wall.

23. A swashplate compressor as set forth in claim 13 wherein said protruding portion is spaced radially from a longitudinal axis of said piston body portion and extending axially wherein said longitudinal axis is along the peripheral of said piston body portion and the piston head portion.

24. A swashplate compressor as set forth in claim 13 wherein said slot is shaped to generally decrease in width as the distance from said shaft increases.

25. A swashplate compressor as set forth in claim 13 wherein said slot has a generally rounded edge along the axial direction of said housing inner surface.

26. A swashplate compressor as set forth in claim 13 wherein said anti-rotation wings prevent rotation of at least one said piston as said swashplate rotates.

27. A swashplate compressor as set forth in claim 13 wherein said axial space is adapted to support a pair of shoes coupling said swashplate.

* * * * *